United States Patent [19]

Andersen

[11] 4,406,240

[45] Sep. 27, 1983

[54] KICKING STRAP FOR SAILING-BOATS

[76] Inventor: Helge B. Andersen, 28 Mosevangen, Kalundborg DK-4400, Denmark

[21] Appl. No.: 253,527

[22] Filed: Apr. 10, 1981

[30] Foreign Application Priority Data

Aug. 10, 1979 [DK] Denmark ..... 3356/79

[51] Int. Cl.[3] ..... B63H 9/10

[52] U.S. Cl. ..... 114/99; 114/102; 267/124

[58] Field of Search ..... 114/97-99, 114/102, 213, 214, 221 R, 223; 267/60, 167, 170, 69, 124, 174, 175; 248/654

[56] References Cited

U.S. PATENT DOCUMENTS

| | | | |
|---|---|---|---|
| 3,169,757 | 2/1965 | Röder et al. | 267/60 |
| 3,173,670 | 3/1965 | Hornsby | 267/60 |
| 3,396,689 | 8/1968 | Sommer | 114/102 |
| 3,464,379 | 9/1969 | Lawson | 114/102 |
| 4,168,800 | 9/1979 | Quick | 267/124 |

FOREIGN PATENT DOCUMENTS

| | | |
|---|---|---|
| 141438 | 3/1980 | Denmark . |
| 1265376 | 4/1968 | Fed. Rep. of Germany . |

*Primary Examiner*—Sherman D. Basinger
*Attorney, Agent, or Firm*—Fitch, Even, Tabin & Flannery

[57] ABSTRACT

A kicking strap for sailing-boats comprises a tackle with two multifold blocks (8, 9) connected and supported by means of two telescopic pipes (15, 16). The pipes are connected by a spring counteracting their joining, e.g. a pneumatic spring (21) secured both to one block (8) and the inner pipe (15), its piston being rigidly connected to the outer pipe (16) through a pin (31) extending through the head of the piston (22). The outer pipe is welded to the second block (9). The pin (31) is guided in an extension of the inner pipe (15). At for instance booming, the kicking strap located between the mast-foot and the boom exerts by means of the spring an upward pressure on the boom so that the boom in the central position during the booming is still raised and may thereby safely pass above the crew.

13 Claims, 6 Drawing Figures

KICKING STRAP FOR SAILING-BOATS

TECHNICAL FIELD

The present invention relates to a kicking strap for sailing-boats and comprising a tackle with a first and a second multifold block mutually connected and supported by means of an inner and an outer pipe or bar mutually slidable relative to their longitudinal direction.

BACKGROUND ART

The kicking straps and downhauls commonly used today comprise two tackles connected by cordage and function only as downhauls for a boom. When the mainsail on a sailing-boat is set, this sail keeps up the boom. However, when the sail is being taken down and during reefing, the boom falls or goes down if not retained in another manner, e.g. by means of a boom topping-lift or a boom saddle.

A downhaul is known comprising a tackle with blocks mutually connected by means of a telescopic connection with two mutually slidable pipes. The two blocks are hinged to boom and mast-foot, respectively, by means of mounting pipes located in extension and on the outside of the telescopic connection. When such a downhaul is used, the boom swings at booming and also in case of slack sails a short distance downwards across the crew whereafter the boom is stopped by the two telescopically located pipes reaching their bottom position.

DISCLOSURE OF INVENTION

The object of the present invention is to provide a kicking strap capable of keeping up the boom in a constant height determined by tightening the tackle blocks when said boom is not kept up by the mainsail, i.e. when the sail is taken down, is being reefed, and at booming. The kicking strap according to the invention is characterised in that a spring means is located between the blocks, said spring means being guided by the pipes or bars and counteracting the joining of blocks. When using such a built-in spring means, the blocks of the tackle are only used for adjusting the block distance and thereby the length of the kicking strap, i.e. the height of the boom above the deck. By means of the tackle comprising the two blocks and the spring means, the mainsail may be provided with the desired twisting, also in case of a quite gentle breeze, i.e. when the wind is too light to raise slightly the boom. Furthermore, such a kicking strap ensures a more quiet booming as the built-in spring calms the movements of the boom. In this manner both the rigging and the sails are carefully treated whereby their time of life is prolonged. Moreover, this spring means implies that during the booming, the boom is kept up in the height determined by the tightening and slacking, respectively, of the tackle. In this manner the boom follows an almost plane surface at booming since the spring means implies that the kicking strap raises the boom in case of slack sails. A boom provided with a common kicking strap sinks slightly and usually it is necessary that the crew of the boat duck in order not to be hit by the boom. The kicking strap according to the invention ensures that the boom follows a curve across the cockpit, whereby the risk of serious accidents is reduced.

According to a preferred embodiment one end of the spring means is fixedly and rigidly connected to the first block, and the opposite end of said spring means is fixedly and rigidly connected to the second block. A pneumatic spring means a spring with a pneumatic effect such as for instance a shock absorber, the pressure of which measured in kp only varies slightly between the outer positions of the piston. The spring may be of the type sold under the name gas spring, and its pressure measured in kp may be chosen in response to the desired tension of the spring depending on the weight of the boom and the sail. Such springs are inter alia marketed by the company Stabilus A. G. and Deutsche Dictator Türschliessergesellschaft, Ruef & Co. Compared to for instance screw springs, these pneumatic springs are easy to replace in case it is desired to change the spring tension.

In a simple and very inexpensive embodiment according to the invention the cylinder housing of the penumatic spring forms the inner pipe preferably secured to the block adjacent the boom and preferably by screwing on, whereas the piston is fixedly connected to the outer pipe through a head member screwed on, said outer pipe being secured to the second block. As a result, a very inexpensive kicking strap is obtained, which meets the requirement of keeping up the boom in the constant height desired when the sail is slack and the rope is slacked.

It is, however, for reasons of support and saftety preferred to use an embodiment, whereby the closed bottom of the cylinder housing of the pneumatic spring is fixedly secured to the inner pipe and one block, preferably the first block adjacent the boom, through securing means, whereas the piston of the pneumatic spring is fixedly secured to the second block through fixedly and rigidly connected portions.

The advantages obtained by the subject matter of the remaining sub-claims are the following.

The plug implies that the connection between the inner pipe, the block, and the pneumatic spring may easily be screwed from each other in case of replacement of the pneumatic spring.

The pin secured to the piston and the outer pipe ensures an efficient and rigid connection between said piston and said outer pipe.

As the pin extends through a head member screwed on the piston, it is ensured that the pin may easily be screwed off at replacement of the pneumatic spring.

The dividing of the outer pipe into two parts facilitates the mounting of the kicking strap according to the invention.

The guiding pipe and the stop located thereon ensure that the spring means is not loaded in the top position, the built-in stop taking over the load, whereas the slots ensure that a free slidability is present relative to the pin thereby capable of transferring the tension and the moderating effect of the spring from the piston to the outer pipe.

BRIEF DESCRIPTION OF DRAWINGS

The invention will be described below with reference to the accompanying drawing, in which.

BEST MODE FOR CARRYING OUT THE INVENTION

Figure 1:
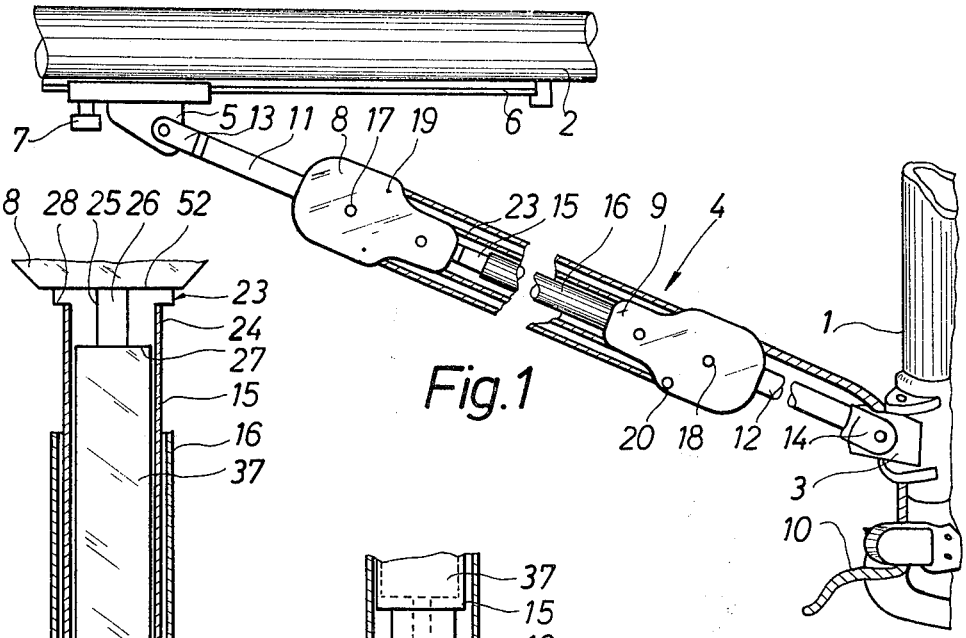
FIG. 1 illustrates a detail of a sailing-boat provided with a kicking strap according to the invention, said kicking strap being mounted between the boom and the mast-foot.

FIG. 1 illustrates the mast-foot 1 of a sailing-boat, to which a boom 2 is hinged by means of a fitting (not shown). A kicking strap 4 according to the invention is hinged on the mast-foot by means of a fitting 3 in such a manner that said kicking strap is pivotable about both a vertical and a horizontal axis. The opposite end of the kicking strap is hinged to a boom fitting 5, which may be formed as a sliding means, cf. the drawing. This sliding means permits sliding along a rail 6 located under the boom 2, and it is locked thereto by means of a spring-loaded locking projection 7.

The kicking strap comprises a tackle with an upper and a lower multifold block 8 and 9, respectively, with ropes 10. An upper and a lower mounting bar 11 and 12, respectively, are welded on the end of the blocks opposite the tackle, said mounting bars comprising crutches 13 and 14, respectively, to be secured on the fittings 5 and 3, respectively. A telescopic connection in the form of an inner pipe 15 and an outer pipe 16 secured to the upper block 8 and the lower block 9, respectively, are provided between said blocks and parallel to and between the rope strands in the stretched condition. Furthermore, the blocks comprise a solid wheel shaft 17 and 18, respectively, as well as pins 19 preventing the rope from being tangled. An eye or a projection 20 acting as rope hold is provided in the lower block 9.

A spring means in the form of a pneumatic spring 21 is located in the inner pipe 15 and firmly connected to one, preferably the upper, block 8. The piston 22 of this pneumatic spring is rigidly connected to the outer pipe 16, which in turn is firmly connected to the second block 9.

The fixed connection between the upper block 8, the inner pipe 15, and the pneumatic spring 21 is provided by means of a plug 23 welded, cf. the Figure at 52, or in another manner secured to the block 8. The plug comprises a male thread 24, on which the inner pipe 15 may be screwed by means of a female thread shaped therein as well as an aperture with a female thread 25. On this female thread 25 a threaded projection 26 may be screwed which is welded on the bottom surface 27 of the pneumatic spring. The plug 23 furthermore comprises contact surfaces 28, against which the upper rim of the outer pipe may abut when the piston 22 is pressed in completely.

In order to provide a rigid connection that can be disconnected, between the piston 22 of the pneumatic spring and the outer pipe 16, the outer end of the piston is provided with a male thread, on which a head member 29 with a female thread 30 extending through an aperture in the head member is screwed. A pin 31 extends perpendicular to the piston and is welded to the outer pipe 16. In order to stiffen the pin 31, said pin extends through two apertures in a sleeve 32, said apertures being located diametrically opposite each other. The sleeve is also welded to the outer pipe 16. It is with respect to mounting preferred that the outer pipe 16 is in two parts connected by a circumferential welding 33 opposite the sleeve 32.

The inner pipe is extended by a slightly narrower guiding pipe 34 comprising a slot 35, in which the pin 31 may slide between its two outer positions during the compression of the pneumatic spring 21. At the end of the guiding pipe 34, a stop 36 is provided which may abut the sleeve 32 when the piston is completely extended.

The above embodiment is suited for a quick replacement of the pneumatic spring by another pneumatic spring with a different pressure in case a heavier spring load is desired or in case the pneumatic spring has lost its tension and is to be replaced by another. This replacement may be performed by simply screwing off the screw connections indicated.

The pneumatic spring may be in an embodiment which is more difficult to keep up, be welded or secured in another manner directly for instance to the upper block 8, whereby its cylinder housing 37 may form the inner pipe. In this case the head member 29 is not necessary and the pin 31 may just extend through an aperture drilled in the end of the piston 22. Since no risk exists in this case of a mutual turning of the portions, the guiding pipe 34 may optionally also be omitted in this embodiment, which, however, is not so solid and reliable in use as the above first preferred embodiment.

Though the downhaul according to the invention is described with a pneumatic spring it is obvious that said spring means may be replaced by other spring means having the same effect, e.g. a coil spring with a corresponding tension.

Usually a pneumatic spring is chosen which possesses a tension capacity of between 30 and 40 kp. Other tension capacities may, however, occur depending on the size of the sail.

Figure 2:
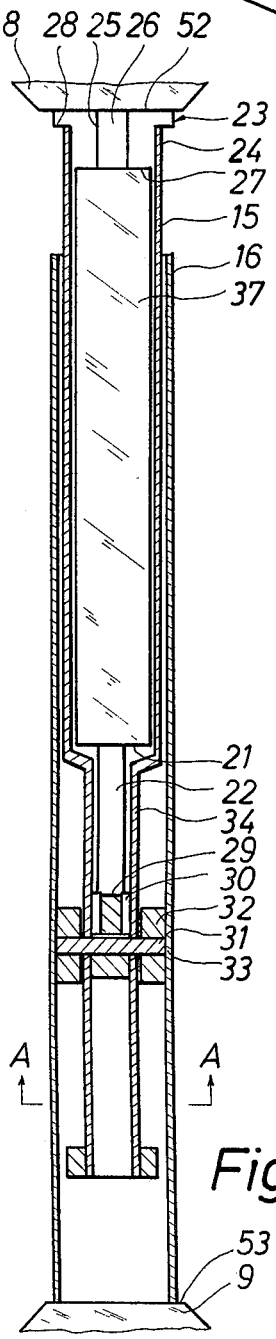
FIG. 2 is a part-sectioned view through two telescopical pipes mutually connected and located between two blocks and provided with a spring means according to the invention.
Figure 3:
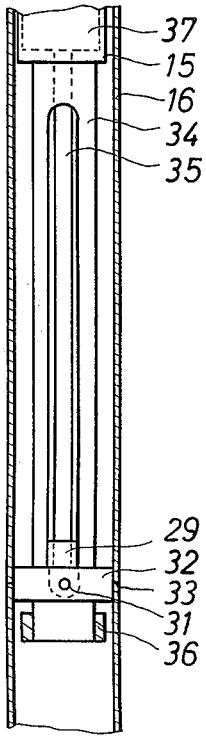
FIG. 3 is a partial view turned 90° through the pipes of FIG. 2, whereby said parts are in a second position.
Figure 4:
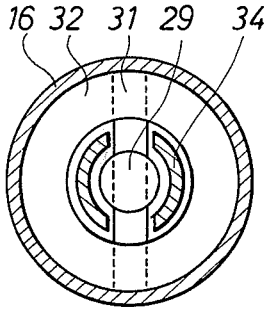
FIG. 4 is a sectional view along the line A—A of the pipes of FIG. 2.
Figure 5:
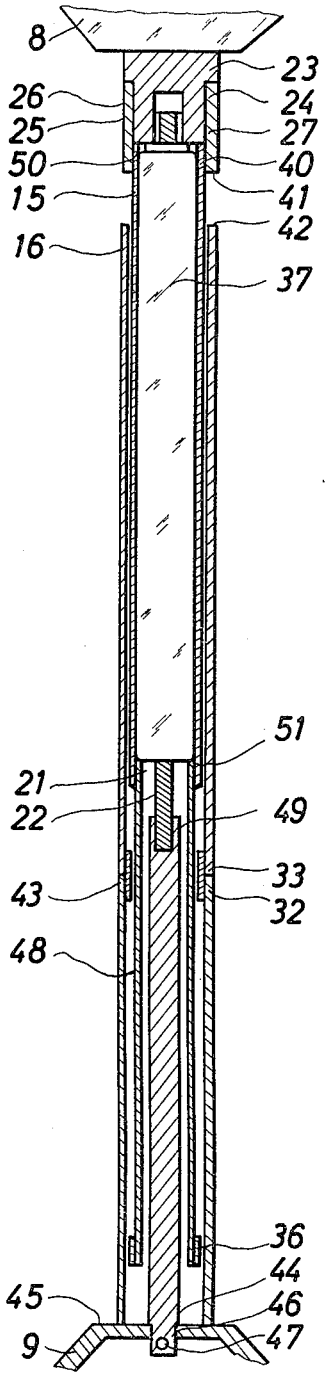
FIG. 5 is a partial view through a part of a variant of the embodiment illustrated in FIGS. 2 and 3.
Figure 6:
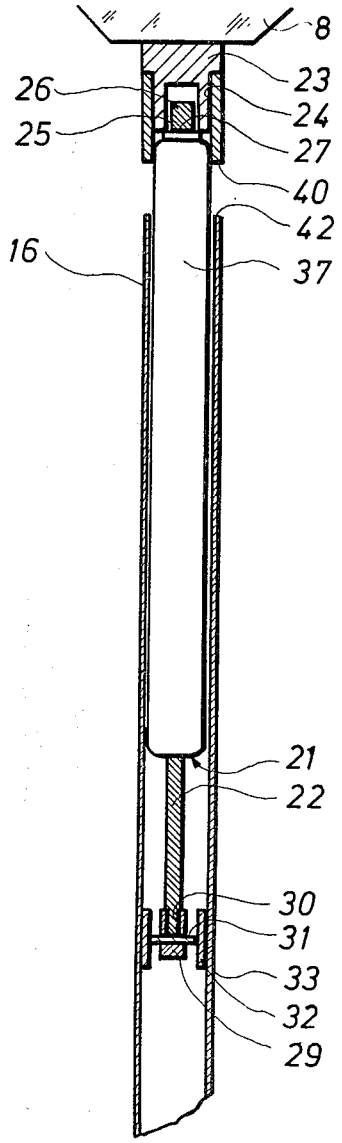
FIG. 6 is a partial view through a part of another variant of the embodiment illustrated in FIGS. 2 and 3.

FIG. 5 illustrates a preferred variant whereby the same reference numerals have been used for the portions corresponding to the portions illustrated in FIG. 2. The portions of the kicking strap illustrated here appear in approximately half-size.

In this embodiment the inner pipe is not screwed directly on the plug 23. In this embodiment a muff 40 is welded or screwed, cf. at 50, on the inner pipe 15, said muff being extended by a female threaded portion screwed on the male thread 24 of the plug 23. The end surface of the muff 40 turning away from the plug 23 forms a contact surface 41 for the corresponding end surface 42 of the outer pipe 16 when the piston 22 rigidly connected to the outer pipe 16 is completely pressed in the cylinder of the pneumatic spring 21.

Furthermore, a connecting bar 43 is in this embodiment secured, e.g. screwed on cf. at 49, to the piston 22. The opposite end of this connecting bar comprises a contact surface 44 fixedly abutting the bottom plate 45 of the second block 9, and a projection 46 extending through a corresponding aperture in the bottom plate. A locking pin 47 extends through a diametral aperture in the projection 46. In this manner the piston 22, the connecting bar 43, the second block 9, and the pipe 16 in two parts welded thereon are mutually fixedly connected in such a manner that they as a unit may slide relative to the cylinder housing 37 of the pneumatic spring and the portions fixedly connected thereto, viz. the fixed block 8, the plug 23, the muff 40, and the inner pipe 15.

The inner pipe 15 is extended by a guiding pipe 48 internally welded or screwed, cf. at 51. The free end of this guiding pipe supports an outer stop 36 welded or shrinked, which when the piston 22 is pressed out completely abuts the corresponding surface of the sleeve 32.

This embodiment is more simple to manufacture than the first embodiment.

I claim:

1. A kicking strap for sailing boats having booms and masts comprising a tackle having a first upper and second lower block, each having at least one sheave and the two being interconnected by a rope passed over said sheaves, said first upper block being hinged to a boom by an upper mounting bar and a boom fitting and said second lower block being hinged at a mast-foot by a lower mounting bar and a fitting;

an inner pipe interconnecting said upper and lower blocks;

an outer pipe telescopically containing said inner pipe, said inner pipe being slidable relative to said outer pipe in the longitudinal direction;

spring means located within and guided by said pipes and connected between said blocks and constantly urging against the shortening of the length between said blocks, whereby the length between said blocks is adjustable by means of said rope passed over said sheaves.

2. A kicking strap as claimed in claim 1, wherein one end of the spring means is fixedly and rigidly connected to the first block, and that the opposite end of said spring means is fixedly and rigidly connected to the second block.

3. A kicking strap as claimed in claim 2, wherein the spring means is a pneumatic spring comprising a cylinder housing having a closed bottom and a piston slidable relative to said cylinder housing.

4. A kicking strap as claimed in claim 3, wherein the cylinder housing of the pneumatic spring forms the inner pipe preferably secured to the block adjacent the boom and preferably by screwing on, whereas the piston is fixedly connected to the outer pipe through a head member screwed on, said outer pipe being secured to the second block.

5. A kicking strap as claimed in claim 3, wherein the closed bottom of the cylinder housing of the pneumatic spring is fixedly secured to the inner pipe and one block, preferably the first block adjacent the boom, through securing means, whereas the piston of the pneumatic spring is fixedly secured to the second block through fixedly and rigidly connected portions.

6. A kicking strap as claimed in claim 5, wherein the securing means is a plug with a male thread welded on the first block, said male thread engaging a female thread on the inner pipe, and an aperture with a female thread engaging a threaded projection secured to the bottom of the cylinder housing of the pneumatic spring.

7. A kicking strap as claimed in claim 5, wherein the portions fixedly securing the piston and the second block are formed by a pin extending through an aperture in the piston and welded diametrically rigidly to the outer pipe and supported by a sleeve internally welded on the outer pipe, said sleeve comprising an aperture for the pin.

8. A kicking strap as claimed in claim 7, wherein a head member with a female thread and an aperture for the pin is screwed on the piston.

9. A kicking strap as claimed in claim 7, wherein the outer pipe is in two parts, and that its two pipe parts are welded together by means of the sleeve.

10. A kicking strap as claimed in claim 7, wherein the inner pipe is extended by a guiding pipe comprising two longitudinal slots, through which the pin extends, and that a stop is secured on the outer end of the guiding pipe.

11. A kicking strap as claimed in claim 5, wherein the securing means is a bottom screw with a male thread welded on the first block, said male thread engaging a female thread on a muff welded on the inner pipe, and an aperture with a female thread engaging a threaded projection secured to the bottom of the cylinder housing of the pneumatic spring.

12. A kicking strap as claimed in claim 11, wherein the portions firmly securing the piston and the second block are formed by a connecting bar secured at one end, e.g. by screwing, to the piston, said connecting bar at its other end resting against a bottom plate of the second block and extending at a projection through said bottom plate and being locked against the bottom plate by means of a pin extending through a diametral aperture in the projection.

13. A kicking strap as claimed in claim 11, wherein the outer pipe is in two parts, and that its two pipe parts are welded together by means of a sleeve, and that the inner pipe is extended with a guiding pipe, a stop being secured on the outer end of said guiding pipe for cooperating with a corresponding surface on the sleeve.

* * * * *